US009370852B2

(12) United States Patent
Takahashi et al.

(10) Patent No.: US 9,370,852 B2
(45) Date of Patent: Jun. 21, 2016

(54) PRESSURE REGULATOR AND POLISHING APPARATUS HAVING THE PRESSURE REGULATOR

(71) Applicant: EBARA CORPORATION, Tokyo (JP)

(72) Inventors: Nobuyuki Takahashi, Tokyo (JP); Toru Maruyama, Tokyo (JP); Suguru Sakugawa, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 43 days.

(21) Appl. No.: 14/590,620

(22) Filed: Jan. 6, 2015

(65) Prior Publication Data

US 2015/0224620 A1 Aug. 13, 2015

(30) Foreign Application Priority Data

Jan. 9, 2014 (JP) ..... 2014-002526

(51) Int. Cl.
*B24B 37/00* (2012.01)
*B24B 37/005* (2012.01)
*B24B 7/22* (2006.01)

(52) U.S. Cl.
CPC ..... *B24B 37/005* (2013.01); *B24B 7/228* (2013.01); *Y10T 137/7761* (2015.04)

(58) Field of Classification Search
CPC ..... B24B 37/005; B24B 7/228; G05D 16/20; G05D 16/2046; G05D 16/2066; G05D 16/2073
USPC ..... 451/5, 6, 41, 285–290
See application file for complete search history.

(56) References Cited

U.S. PATENT DOCUMENTS 5,762,539 A * 6/1998 Nakashiba ..... B24B 49/16 451/285
5,799,688 A * 9/1998 Yie ..... B05B 1/3046 137/505.13
6,129,613 A * 10/2000 Bothra ..... B24B 34/30 257/417
6,241,578 B1 * 6/2001 Togawa ..... B24B 37/013 451/24
6,275,290 B1 * 8/2001 Cerni ..... A61B 90/36 356/335

(Continued)

FOREIGN PATENT DOCUMENTS

JP 2005-105298 A 4/2001
JP 2005-081507 A 3/2005

(Continued)

*Primary Examiner* — George Nguyen
(74) *Attorney, Agent, or Firm* — Pearne & Gordon LLP

(57) ABSTRACT

A pressure regulator capable of improving both stability of pressure and responsiveness to an input signal is disclosed. A PID controller is configured to stop producing a corrective command value from a point in time when a pressure command value has changed until a PID control starting point and to produce the corrective command value after the PID control starting point. A regulator controller is configured to control operation of a pressure regulation valve so as to eliminate a difference between the pressure command value and a first pressure value from the point in time when the pressure command value has changed until the PID control starting point, and to control the operation of the pressure regulation valve so as to eliminate a difference between the corrective command value and the first pressure value after the PID control starting point.

6 Claims, 16 Drawing Sheets

(56) References Cited

U.S. PATENT DOCUMENTS 6,594,542 B1 * 7/2003 Williams ..... B24B 37/013 156/345.13
6,857,947 B2 * 2/2005 Wang ..... B24B 21/04 451/288
6,901,761 B1 * 6/2005 Berkeley ..... F23C 7/008 60/740
6,926,585 B2 * 8/2005 Togawa ..... B24B 49/16 451/288
7,207,871 B1 * 4/2007 Zuniga ..... B24B 49/16 451/288
8,382,554 B2 * 2/2013 Kim ..... B24B 37/042 451/11
2014/0087629 A1 * 3/2014 Takahashi ..... B24B 7/228 451/5

FOREIGN PATENT DOCUMENTS

JP 2007-507079 A 3/2007
JP 2010-050436 A 3/2010

* cited by examiner

| | | CONVENTIONAL PRESSURE REGULATOR | | | | INVENTIVE PRESSURE REGULATOR | | | |
|---|---|---|---|---|---|---|---|---|---|
| | | LINEARITY | HYSTERESIS | STABILITY | REPEATABILITY | LINEARITY | HYSTERESIS | STABILITY | REPEATABILITY |
| 1 | 6.64 | 0.20 | 0.31 | 1.29 | 0.31 | 0.09 | 0.04 | 0.08 | |
| 2 | 6.67 | 0.23 | 0.21 | | 0.27 | 0.05 | 0.03 | | |
| 3 | 6.68 | 0.28 | 0.47 | | 0.27 | 0.07 | 0.03 | | |
| 4 | 6.68 | 0.28 | 0.30 | | 0.26 | 0.05 | 0.03 | | |
| 5 | 6.62 | 0.21 | 0.24 | | 0.27 | 0.07 | 0.03 | | |

PRESSURE REGULATOR AND POLISHING APPARATUS HAVING THE PRESSURE REGULATOR

CROSS REFERENCE TO RELATED APPLICATION

This document claims priority to Japanese Patent Application Number 2014-002526 filed Jan. 9, 2014, the entire contents of which are hereby incorporated by reference.

BACKGROUND

FIG. 15 is a schematic view of a polishing apparatus for polishing a wafer. As shown in FIG. 15, the polishing apparatus includes a polishing table 22 for supporting a polishing pad 23 thereon, and a top ring 30 for pressing a wafer W against the polishing pad 23. The polishing table 22 is coupled via a table shaft 22*a* to a table motor 29 disposed below the polishing table 22, so that the polishing table 22 is rotated by the table motor 29 in a direction indicated by arrow. The polishing pad 23 is attached to an upper surface of the polishing table 22, and an upper surface of the polishing pad 23 provides a polishing surface 23*a* for polishing the wafer W. The top ring 30 is secured to a lower end of a top ring shaft 27. The top ring 30 is configured to be able to hold the wafer W on its lower surface by vacuum suction.

Polishing of the wafer W is performed as follows. The top ring 30 and the polishing table 22 are rotated in directions indicated by arrows, respectively, while a polishing liquid (or slurry) is supplied from a polishing liquid supply structure 25 onto the polishing pad 23. In this state, the top ring 30, holding the wafer W on its lower surface, is lowered and presses the wafer W against the polishing surface 23*a* of the polishing pad 23. A surface of the wafer W is polished by a mechanical action of abrasive grains contained in the polishing liquid and a chemical action of the polishing liquid. The polishing apparatus having such structures is known as CMP (Chemical Mechanical Polishing) apparatus.

A pressure chamber (not shown in FIG. 15) that is defined by an elastic membrane is provided at a lower portion of the top ring 30. This pressure chamber is supplied with a pressurized gas so that a polishing pressure applied to the wafer W on the polishing pad 23*a* is adjusted. FIG. 16 is a schematic diagram showing a pressure regulator 100 for regulating the pressure in the pressure chamber of the top ring 30 by supplying a gas (air, nitrogen, or the like) into the pressure chamber. As shown in FIG. 16, the pressure regulator 100 includes a pressure regulation valve 101 for regulating the pressure of the gas supplied from a gas supply source, a pressure sensor 102 for measuring the pressure (secondary pressure) of the gas downstream of the pressure regulation valve 101, and a regulator controller 103 for controlling operation of the pressure regulation valve 101 based on a pressure value obtained by the pressure sensor 102. The pressure regulator 100 having such structures is known as an electropneumatic regulator.

The pressure regulation valve 101 has a pilot valve 110 for regulating the pressure of the gas supplied from the gas supply source, and a gas-supply solenoid valve 111 and a gas-exhaust solenoid valve 112 each for regulating the pressure of pilot air to be delivered to the pilot valve 110. The pilot valve 110 has a pilot chamber 115 partly defined by a diaphragm, and further has a valve element 116 coupled to the pilot chamber 115. The pilot air is delivered through the gas-supply solenoid valve 111 into the pilot chamber 115, and the pilot air in the pilot chamber 115 is discharged through the gas-exhaust solenoid valve 112. Therefore, the pressure in the pilot chamber 115 is regulated by the operations of the gas-supply solenoid valve 111 and the gas-exhaust solenoid valve 112. The regulator controller 103 controls the solenoid valves 111, 112 to open and close, and the valve element 116 moves in accordance with the pressure in the pilot chamber 115. Depending on a position of the valve element 116, the gas from the gas supply source passes through the pilot valve 110, or the gas that is present downstream (secondary side) of the pilot valve 110 is discharged through the pilot valve 110. The pressure of the gas that is present downstream of the pilot valve 110, i.e., the secondary pressure, is thus regulated.

The regulator controller 103 is coupled to a polishing controller 50 of the polishing apparatus, and receives a pressure command value sent from the polishing controller 50. The regulator controller 103 controls the operations of the gas-supply solenoid valve 111 and the gas-exhaust solenoid valve 112 in order to eliminate a difference between a present pressure value of the gas measured by the pressure sensor 102 and the pressure command value to thereby regulate the pressure in the pressure chamber of the top ring 30.

However, the pressure regulator of the above structures is problematic in that either stability of the pressure or responsiveness to an input signal is low. Specifically, if the stability of the pressure is improved, then a response time is lowered, and if the responsiveness is improved, then the pressure becomes unstable.

SUMMARY OF THE INVENTION

According to an embodiment, there is provided a pressure regulator capable of improving both stability of pressure and responsiveness to an input signal. Further, according to an embodiment, there is provided a polishing apparatus having such a pressure regulator.

Embodiments, which will be described below, relate to a pressure regulator for regulating pressure in a pressure chamber that is used to press a substrate, such as a wafer, against a polishing pad. Further, embodiments, which will be described below, relate to a polishing apparatus having such a pressure regulator.

In an embodiment, there is provided a pressure regulator comprising: a pressure regulation valve configured to regulate a pressure of a fluid supplied from a fluid supply source; a first pressure sensor configured to measure the pressure regulated by the pressure regulation valve; a second pressure sensor located downstream of the first pressure sensor; a PID controller configured to produce a corrective command value for eliminating a difference between a pressure command value inputted from an external device and a second pressure value of the fluid measured by the second pressure sensor, the PID controller being configured to stop producing the corrective command value from a point in time when the pressure command value has changed until a PID control starting point and to produce the corrective command value after the PID control starting point that represents a moment at which a preset delay time has elapsed; and a regulator controller configured to control operation of the pressure regulation valve so as to eliminate a difference between a first pressure value of the fluid measured by the first pressure sensor and one of the pressure command value and the corrective command value, the regulator controller being configured to control the operation of the pressure regulation valve so as to eliminate the difference between the pressure command value and the first pressure value from the point in time when the pressure command value has changed until the PID control starting point, and to control the operation of the pressure regulation valve so as to eliminate the difference between the corrective command value and the first pressure value after the PID control starting point.

In an embodiment, there is provided a polishing apparatus comprising: a polishing table for supporting a polishing pad thereon; a top ring configured to press a substrate against the polishing pad on the polishing table, the top ring having a pressure chamber for pressing the substrate against the polishing pad; a polishing controller configured to control operation of the top ring; and a pressure regulator coupled to the top ring and configured to regulate a pressure in the pressure chamber, the pressure regulator including: a pressure regulation valve configured to regulate pressure of a fluid supplied from a fluid supply source; a first pressure sensor configured to measure the pressure regulated by the pressure regulation valve; a second pressure sensor located downstream of the first pressure sensor; a PID controller configured to produce a corrective command value for eliminating a difference between a pressure command value inputted from the polishing controller and a second pressure value of the fluid measured by the second pressure sensor, the PID controller being configured to stop producing the corrective command value from a point in time when the pressure command value has changed until a PID control starting point and to produce the corrective command value after the PID control starting point that represents a moment at which a preset delay time has elapsed; and a regulator controller configured to control operation of the pressure regulation valve so as to eliminate a difference between a first pressure value of the fluid measured by the first pressure sensor and one of the pressure command value and the corrective command value, the regulator controller being configured to control the operation of the pressure regulation valve so as to eliminate the difference between the pressure command value and the first pressure value from the point in time when the pressure command value has changed until the PID control starting point, and to control the operation of the pressure regulation valve so as to eliminate the difference between the corrective command value and the first pressure value after the PID control starting point.

The first pressure sensor and the regulator controller provide a first loop control, while the second pressure sensor and the PID controller provide a second loop control. From the point in time when the pressure command value (i.e., a target pressure value), sent from the external device, has changed until the PID control starting point, the second loop control does not participate in the pressure control, and only the first loop control participates in the pressure control. Consequently, the pressure regulator can regulate the pressure in quick response to the change in the pressure command value. After the PID control starting point, both the first loop control and the second loop control participate in the pressure control. Therefore, the pressure regulator is able to regulate the pressure stably.

DESCRIPTION OF EMBODIMENTS

Embodiments will be described below with reference to the drawings.

Figure 1:
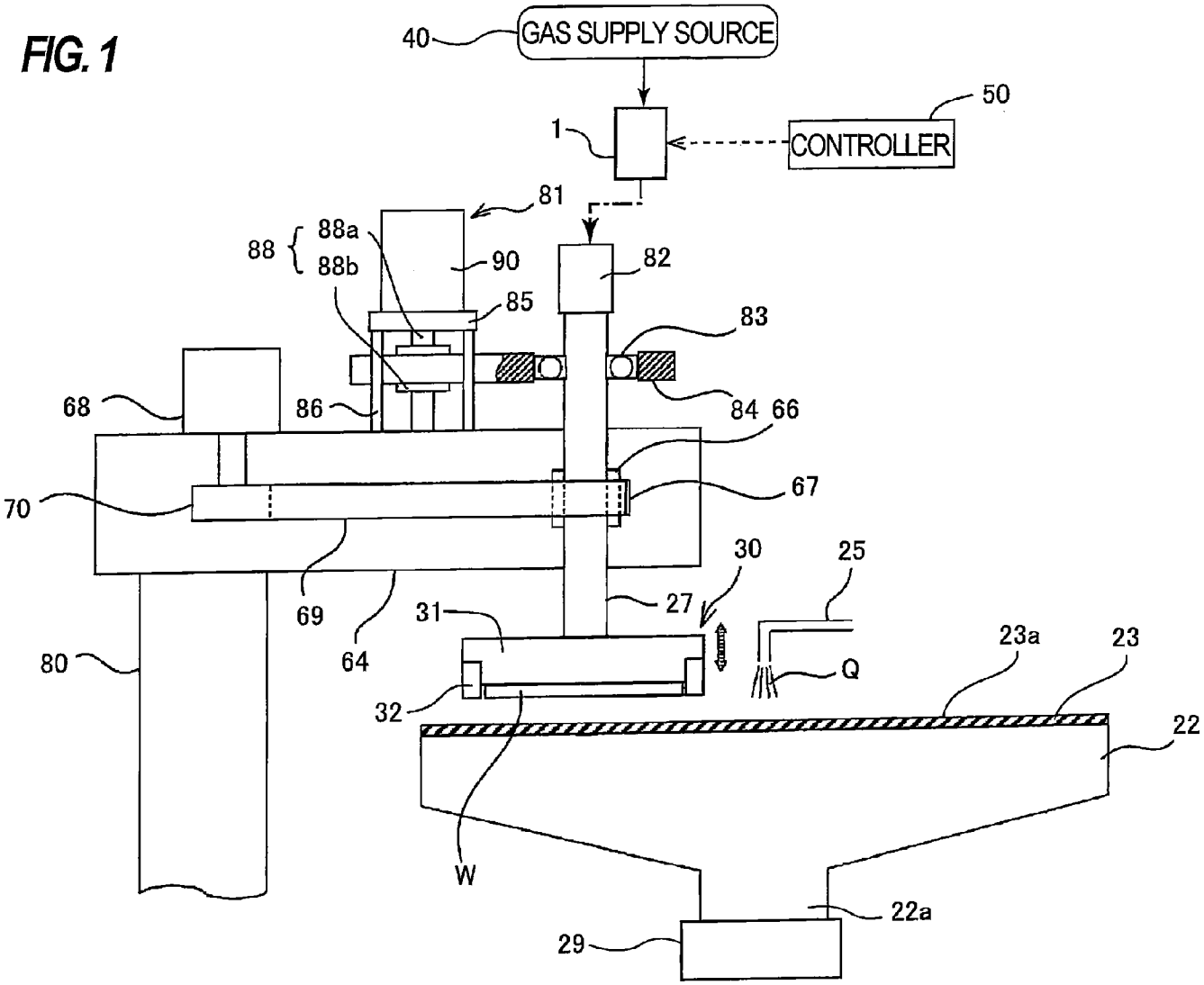
FIG. 1 is a view of a polishing apparatus having a pressure regulator according to an embodiment.

FIG. 1 is a view showing a polishing apparatus having a pressure regulator according to an embodiment. As shown in FIG. 1, the polishing apparatus includes a polishing table 22 for supporting a polishing pad 23, and a top ring (or a substrate holder) 30 for holding a substrate (e.g., wafer), which is a workpiece to be polished, and pressing the substrate against the polishing pad 23 on the polishing table 22.

The polishing table 22 is coupled via a table shaft 22*a* to a table motor 29 disposed below the polishing table 22, so that the polishing table 22 is rotatable about the table shaft 22*a*. The polishing pad 23 is attached to an upper surface of the polishing table 22. A surface 23*a* of the polishing pad 23 serves as a polishing surface for polishing a wafer W. A polishing liquid supply structure 25 is provided above the polishing table 22 so that the polishing liquid supply structure 25 supplies a polishing liquid Q onto the polishing pad 23 on the polishing table 22.

The top ring 30 includes a top ring body 31 for pressing the wafer W against the polishing surface 23*a*, and a retaining ring 32 for retaining the wafer W therein so as to prevent the wafer W from slipping out of the top ring 30. The top ring 30 is coupled to a top ring shaft 27, which is vertically movable relative to a top ring head 64 by a vertically moving mechanism 81. This vertical movement of the top ring shaft 27 causes the entirety of the top ring 30 to move upward and downward relative to the top ring head 64 and enables positioning of the top ring 30. A rotary joint 82 is mounted to an upper end of the top ring shaft 27.

The vertically moving mechanism 81 for elevating and lowering the top ring shaft 27 and the top ring 30 includes a bridge 84 that rotatably supports the top ring shaft 27 through a bearing 83, a ball screw 88 mounted to the bridge 84, a support pedestal 85 supported by support posts 86, and a servomotor 90 mounted to the support pedestal 85. The support pedestal 85, which supports the servomotor 90, is fixedly mounted to the top ring head 64 through the support posts 86.

The ball screw 88 includes a screw shaft 88*a* coupled to the servomotor 90 and a nut 88*b* that engages with the screw shaft 88*a*. The top ring shaft 27 is vertically movable together with the bridge 84. When the servomotor 90 is set in motion, the bridge 84 moves vertically through the ball screw 88, so that the top ring shaft 27 and the top ring 30 move vertically.

The top ring shaft 27 is coupled to a rotary sleeve 66 by a key (not shown). A timing pulley 67 is secured to a circumferential surface of the rotary sleeve 66. A top-ring rotating motor 68 is fixed to the top ring head 64. The timing pulley 67 is coupled through a timing belt 69 to a timing pulley 70, which is mounted to the top-ring rotating motor 68. When the top-ring rotating motor 68 is set in motion, the rotary sleeve 66 and the top ring shaft 27 are rotated together with the timing pulley 70, the timing belt 69, and the timing pulley 67, thus rotating the top ring 30. The top ring head 64 is supported by a top ring head shaft 80, which is rotatably supported by a frame (not shown). The polishing apparatus includes a polishing controller 50 for controlling devices including the top-ring rotating motor 68 and the servomotor 90.

The top ring 30 is configured to be able to hold the wafer W on its lower surface. The top ring head 64 is configured to be able to pivot on the top ring head shaft 80. Thus, the top ring 30, when holding the wafer W on its lower surface, is moved from a position at which the top ring 30 receives the wafer W to a position above the polishing table 22 by a pivotal movement of the top ring head 64. Polishing of the wafer W is performed as follows. The top ring 30 and the polishing table 22 are rotated individually, while the polishing liquid Q is supplied from the polishing liquid supply structure 25, located above the polishing table 22, onto the polishing pad 23. In this state, the top ring 30 is lowered and then presses the wafer W against the polishing surface 23*a* of the polishing pad 23. The wafer W is placed in sliding contact with the polishing surface 23*a* of the polishing pad 23, so that a surface of the wafer W is polished.

Figure 2:
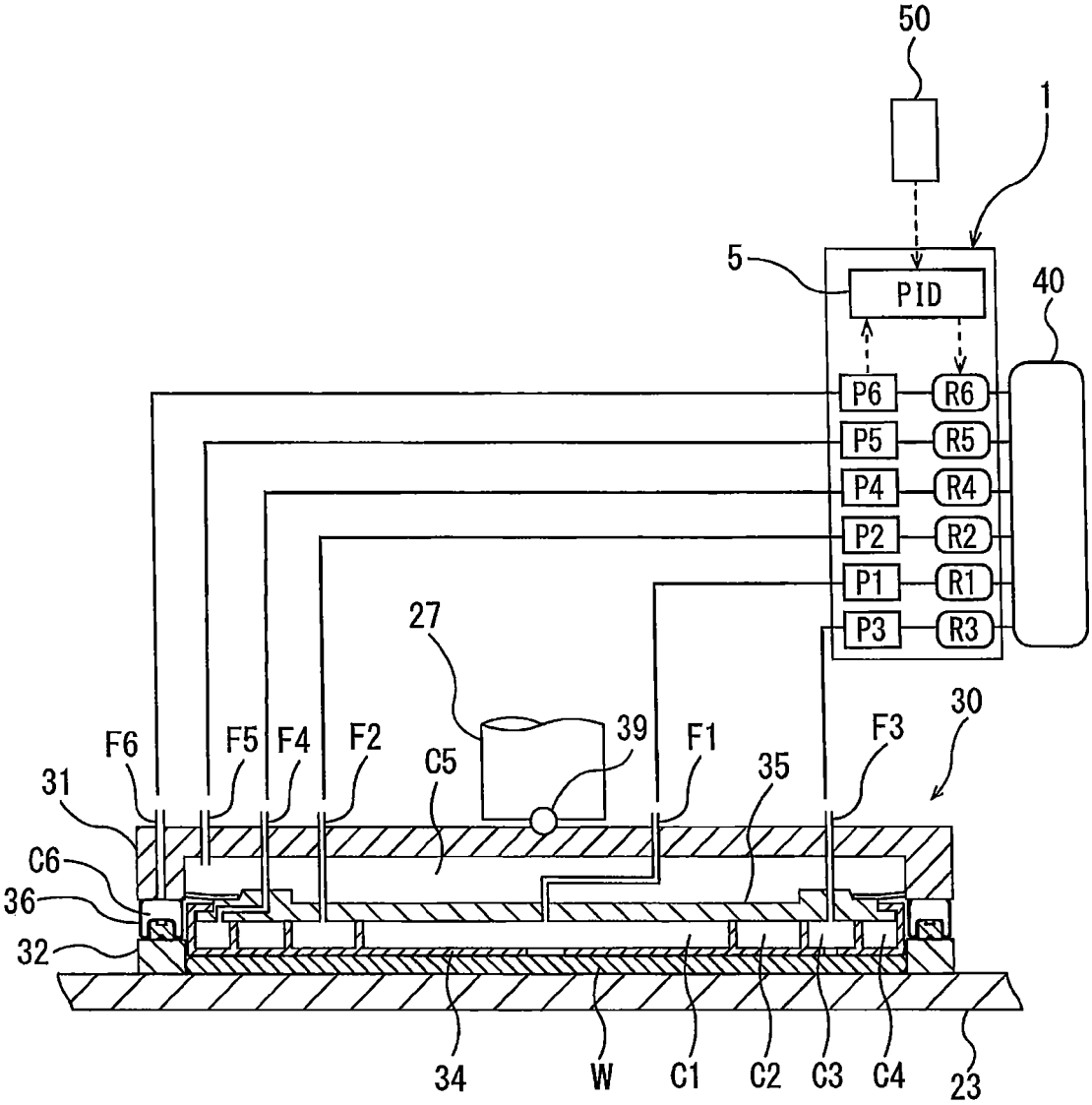
FIG. 2 is a cross-sectional view of a top ring of the polishing apparatus.

Next, the top ring 30 will be described. FIG. 2 is a cross-sectional view showing the top ring 30. The top ring 30 has a top ring body 31 coupled to the top ring shaft 27 via a universal joint 39, and a retaining ring 32 provided below the top ring body 31.

A flexible membrane (or an elastic membrane) 34 to be brought into contact with the wafer W and a chucking plate 35 that holds the membrane 34 are disposed below the top ring body 31. Four pressure chambers C1, C2, C3, and C4 are provided between the membrane 34 and the chucking plate 35. The pressure chambers C1, C2, C3, and C4 are formed by the membrane 34 and the chucking plate 35. The central pressure chamber C1 has a circular shape, and the other pressure chambers C2, C3, and C4 have an annular shape. These pressure chambers C1, C2, C3, and C4 are in a concentric arrangement.

Pressurized gas (or pressurized fluid), such as pressurized air, is supplied from a gas supply source (or a fluid supply source) 40 through fluid passages F1, F2, F3, and F4 into the pressure chambers C1, C2, C3, and C4, respectively. Further, negative pressure can be produced in the pressure chambers C1, C2, C3, and C4 by a vacuum source (not shown). The pressures in the pressure chambers C1, C2, C3, and C4 can be changed independently to thereby independently adjust polishing pressures on four corresponding zones of the wafer W: a central portion; an inner intermediate portion; an outer intermediate portion; and a peripheral portion. In addition, the retaining ring 32 can press the polishing pad 23 at a predetermined pressure by elevating or lowering the entirety of the top ring 30.

A pressure chamber C5 is formed between the chucking plate 35 and the top ring body 31. The pressurized gas is supplied from the gas supply source 40 through a fluid passage F5 into the pressure chamber C5. Further, negative pressure can be produced in the pressure chamber C5 by the vacuum source (not shown). With these operations, the entirety of the chucking plate 35 and the membrane 34 can move up and down. The retaining ring 32 is arranged around the peripheral portion of the wafer W so as to prevent the wafer W from slipping out of the top ring 30 during polishing of the wafer W. The membrane 34 has an opening in a portion that forms the pressure chamber C3, so that the wafer W can be held on the top ring 30 by vacuum suction when a vacuum is produced in the pressure chamber C3. Further, the wafer W can be released from the top ring 30 by supplying nitrogen gas or clean air into the pressure chamber C3.

An annular rolling diaphragm 36 is provided between the top ring body 31 and the retaining ring 32. A pressure chamber C6 is formed in this rolling diaphragm 36, and is in communication with the gas supply source 40 through a fluid passage F6. The gas supply source 40 supplies the pressurized gas into the pressure chamber C6, so that the rolling diaphragm 36 presses the retaining ring 32 against the polishing pad 23.

The fluid passages F1, F2, F3, F4, F5, and F6, communicating with the pressure chambers C1, C2, C3, C4, CS, and C6, respectively, are provided with electropneumatic regulators R1, R2, R3, R4, R5, and R6, respectively. The pressurized gas from the gas supply source 40 is supplied through the electropneumatic regulators R1 to R6 into the pressure chambers C1 to C6. The electropneumatic regulators R1 to R6 are configured to regulate the pressure in the pressure chambers C1 to C6 by regulating the pressure of the pressurized gas supplied from the gas supply source 40. The electropneumatic regulators R1 to R6 are coupled to a PID controller 5, which is coupled to the polishing controller 50. The PID controller 5 may be incorporated in the polishing controller 50. The pressure chambers C1 to C6 are further coupled to vent valves (not shown), respectively, so that the pressure chambers C1 to C6 can be ventilated to the atmosphere.

In-line pressure sensors P1, P2, P3, P4, P5, P6 are disposed between the electropneumatic regulators R1, R2, R3, R4, R5, R6 and the top ring 30 which is a point of use of the pressurized gas. The in-line pressure sensors P1 to P6 are coupled respectively to the fluid passages F1 to F6 that are in fluid communication with the pressure chambers C1 to C6. The in-line pressure sensors P1 to P6 are configured to measure the pressures in the fluid passages F1 to F6 and the pressure chambers C1 to C6.

Figure 3:
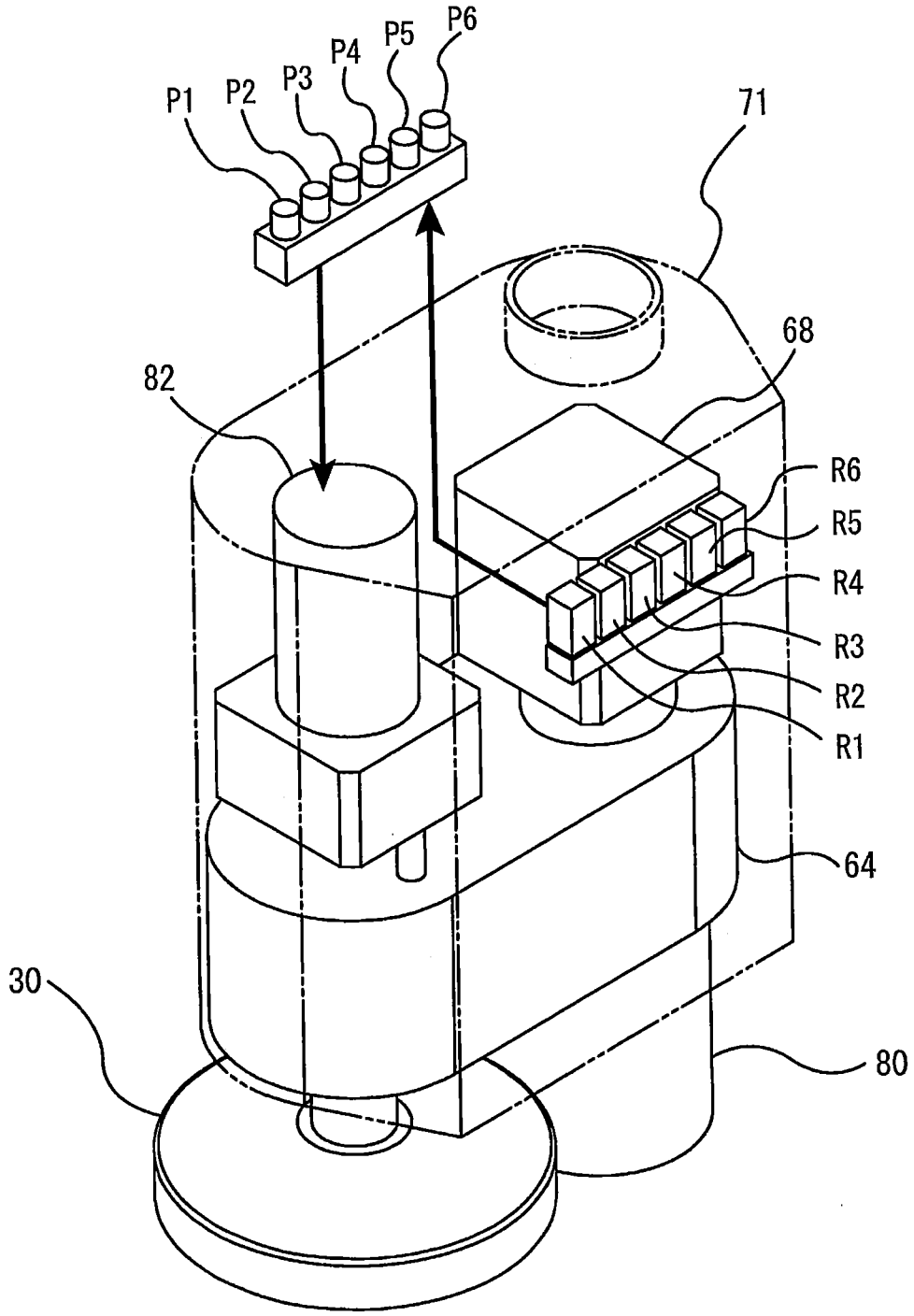
FIG. 3 is a perspective view showing a part of the polishing apparatus.

FIG. 3 is a perspective view showing arrangement of the electropneumatic regulators R1 to R6 and the in-line pressure sensors P1 to P6. As shown in FIG. 3, the electropneumatic regulators R1 to R6 are mounted to the top-ring rotating motor 68. The in-line pressure sensors P1 to P6 are located away from the electropneumatic regulators R1 to R6 and the top ring head 64 in order to prevent a temperature drift from occurring in the in-line pressure sensors P1 to P6 due to heat emitted from heat sources including the top-ring rotating motor 68 and the rotary joint 82. In order to keep the in-line pressure sensors P1 to P6 away from these heat sources, the in-line pressure sensors P1 to P6 are spaced from the top ring head 64. More specifically, the in-line pressure sensors P1 to P6 are located outside of a top ring head cover 71 and within the polishing apparatus.

The in-line pressure sensors P1 to P6 may preferably be installed in an atmosphere that is kept at a constant temperature. For example, the in-line pressure sensors P1 to P6 are installed in an open space within the polishing apparatus, such as a space outside of the top ring head cover 71. Generally, the polishing apparatus is installed in a clean room, which is equipped with a temperature regulating device for keeping a temperature constant in the clean room. Therefore, in order to keep the temperature of the atmosphere surrounding the in-line pressure sensors P1 to P6 constant, the in-line pressure sensors P1 to P6 may preferably be installed in the open space whose temperature is close to the temperature in the clean room. For example, the in-line pressure sensors P1 to P6 may be disposed on a ceiling of the polishing apparatus. The in-line pressure sensors P1 to P6 may be installed outside of the polishing apparatus. For example, the in-line pressure sensors P1 to P6 may be mounted to an outer surface of the polishing apparatus or at a site spaced from the polishing apparatus. The in-line pressure sensors P1 to P6 preferably have their measuring points located as close to the top ring 30, which is the point of use of the pressurized gas, as possible.

The polishing controller 50 is configured to produce pressure command values that are target pressure values for the pressure chambers C1 to C6. The pressure command values for the pressure chambers C1, C2, C3, C4 are produced based on film-thickness measured values in the zones of the wafer surface corresponding respectively to the pressure chambers C1, C2, C3, C4. The polishing controller 50 sends the pressure command values to the PID controller 5, which produces corrective command values for eliminating differences between the present pressure values, measured by the in-line pressure sensors P1 to P6, and the corresponding pressure command values. The PID controller 5 sends the corrective command values to the electropneumatic regulators R1 to R6, which operate to make the pressures in the pressure chambers C1 to C6 equal to the corresponding corrective command values. The top ring 30 having the multiple pressure chambers is capable of pressing the multiple zones of the wafer surface independently against the polishing pad 23 as the polishing process progresses. Therefore, the top ring 30 can uniformly polish a film of the wafer W.

The electropneumatic regulators R1 to R6, the in-line pressure sensors P1 to P6, and the PID controller 5 constitute a pressure regulator 1 for regulating the pressures in the pressure chambers C1 to C6 of the top ring 30. The electropneumatic regulators R1 to R6 have the same structure as each other, and are coupled in parallel. Similarly, the in-line pressure sensors P1 to P6 have the same structure as each other, and are coupled in parallel. The in-line pressure sensors P1 to P6 are coupled in series to the electropneumatic regulators R1 to R6, respectively. A plurality of PID controllers 5 may be provided in association with plural electropneumatic regulators and plural in-line pressure sensors. While the pressure regulator 1 in this embodiment has the plural electropneumatic regulators R1 to R6 and the plural in-line pressure sensors P1 to P6, the pressure regulator 1 may have a single electromagnetic regulator and a single in-line pressure sensor.

Figure 4:
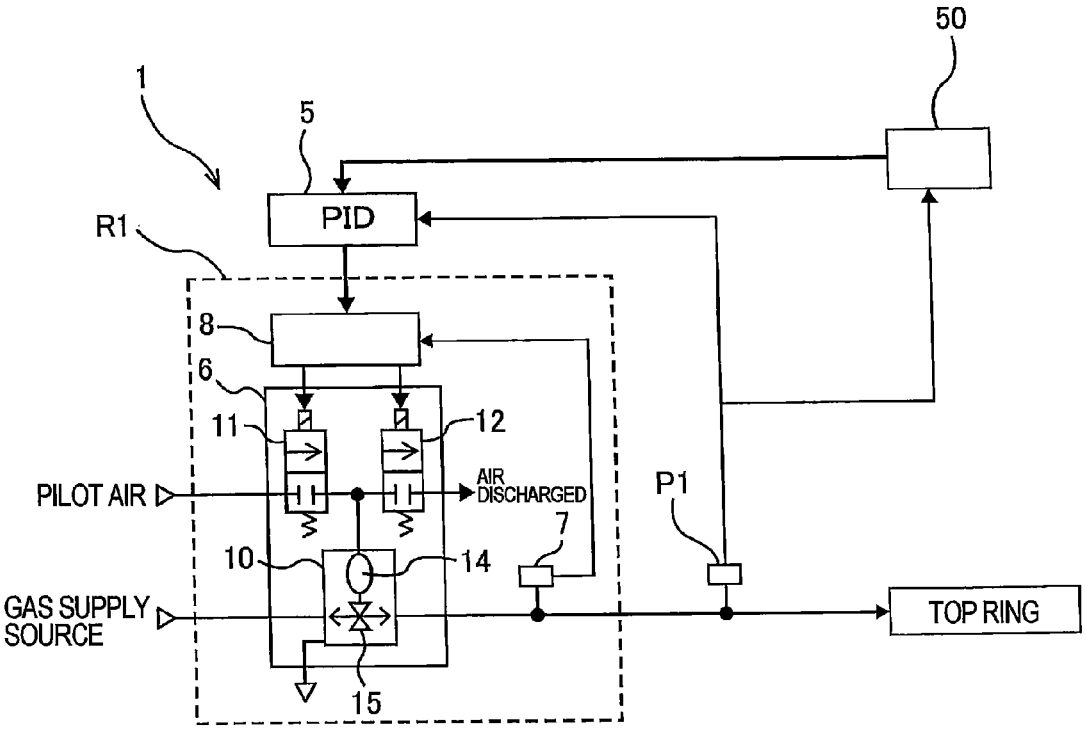
FIG. 4 is a schematic diagram of the pressure regulator according to the embodiment.

For the sake of brevity, an embodiment of the pressure regulator 1 having one electromagnetic regulator R1 and one in-line pressure sensor P1 will be described below with reference to FIG. 4. As shown in FIG. 4, the pressure regulator 1 includes electromagnetic regulator R1, in-line pressure sensor P1 disposed downstream of (at a secondary side of) the electromagnetic regulator R1, and PID controller 5 coupled to the in-line pressure sensor P1.

The electromagnetic regulator R1 includes a pressure regulation valve 6 for regulating the pressure of the gas supplied from the gas supply source 40, an internal pressure sensor (or a first pressure sensor) 7 for measuring the pressure (secondary pressure) of the gas downstream of the pressure regulation valve 6, and a regulator controller 8 for controlling operation of the pressure regulation valve 6 based on a pressure value obtained by the internal pressure sensor 7.

The pressure regulation valve 6 has a pilot valve 10 for regulating the pressure of the gas supplied from the gas supply source 40, and a gas-supply solenoid valve 11 and a gas-exhaust solenoid valve 12 for regulating pressure of pilot air to be delivered to the pilot valve 10. The pilot valve 10 has a pilot chamber 14 partly defined by a diaphragm, and further has a valve element 15 coupled to the pilot chamber 14. The pilot air is delivered through the gas-supply solenoid valve 11 into the pilot chamber 14, and the pilot air in the pilot chamber 14 is discharged through the gas-exhaust solenoid valve 12. Therefore, the pressure in the pilot chamber 14 is regulated by operating the gas-supply solenoid valve 11 and the gas-exhaust solenoid valve 12. The regulator controller 8 controls solenoid valves 11, 12 to open and close, and the valve element 15 moves in accordance with the pressure in the pilot chamber 14. Depending on a position of the valve element 15, the gas from the gas supply source 40 passes through the pilot valve 10, or the gas that is present downstream (secondary side) of the pilot valve 10 is discharged through the pilot valve 10. The pressure of the gas that is present downstream of the pilot valve 10, i.e., the secondary pressure, is thus regulated. The electropneumatic regulator R1 constructed as described above is an electropneumatic regulator that regulates pressure by controlling duty ratios of the gas-supply solenoid valve 11 and the gas-exhaust solenoid valve 12. The present invention is not limited to this type of electropneumatic regulator, and is also applicable to an electropneumatic regulator of other types, such as a proportional-control-valve-type electropneumatic regulator and a force-balancing electropneumatic regulator.

The pressure regulation valve 6, the regulator controller 8, and the internal pressure sensor (first pressure sensor) 7 are assembled together to form the electropneumatic regulator R1, while the in-line pressure sensor (second pressure sensor) P1 is separated from the electropneumatic regulator R1 The in-line pressure sensor P1 is located downstream of the internal pressure sensor 7, and is located between the electropneumatic regulator R1 and the top ring 30. The in-line pressure sensor P1 may preferably have its pressure measuring point located near the top ring 30 that is a point of use. The in-line pressure sensor P1 is configured to measure the pressure of the gas that exists downstream of the electropneumatic regulator R1, i.e., the present pressure in the fluid passage F1 and the pressure chamber C1, and sends the obtained present pressure value to the PID controller 5.

The in-line pressure sensor P1 has a pressure-measuring accuracy higher than that of the internal pressure sensor 7. More specifically, the in-line pressure sensor P1 is superior in pressure-measuring accuracy to the internal pressure sensor 7 in terms of all evaluation items including linearity, hysteresis, stability, and repeatability which are generally used as indexes representing a pressure-measuring accuracy of a pressure sensor.

The internal pressure sensor 7 and the in-line pressure sensor P1 are disposed downstream of the pressure regulation valve 6. Therefore, the internal pressure sensor (first pressure sensor) 7 measures pressure at the secondary side of the pressure regulation valve 6 to obtain a measured value (first pressure value) of the pressure, and the in-line pressure sensor (second pressure sensor) P1 further measures pressure at the secondary side of the pressure regulation valve 6 to obtain a measured value (second pressure value) of the pressure.

As shown in FIG. 4, the in-line pressure sensor P1 is coupled to the polishing controller 50, and the present pressure value obtained by the in-line pressure sensor P1 is sent to the polishing controller 50. The polishing controller 50 uses this present pressure value as a value representing the present pressure in the pressure chamber P1 of the top ring, and produces the above-described pressure command value based on the present pressure value.

The PID controller 5 is coupled to the polishing controller 50 of the polishing apparatus. The pressure command value produced by the polishing controller 50 is sent to the PID controller 5. The PID controller 5 produces a corrective command value (analog signal) for eliminating a difference between the present pressure value and the pressure command value, and sends the corrective command value to the regulator controller 8. The regulator controller 8 controls the operations of the gas-supply solenoid valve 11 and the gas-exhaust solenoid valve 12 so as to eliminate a difference between pressure value sent from the internal pressure sensor 7 and the corrective command value.

The pilot air in the pilot chamber 14 actuates the valve element 15 of the pilot valve 10 to thereby regulate the pressure of the gas (air, nitrogen, or the like). The pressure of the gas that is present downstream of the pilot valve 10 is measured by the internal pressure sensor 7 and is further measured by the in-line pressure sensor P1 that is arranged downstream of the internal pressure sensor 7. The present pressure value obtained by the internal pressure sensor 7 is fed back to the regulator controller 8, and the present pressure value obtained by the in-line pressure sensor P1 is fed back to the PID controller 5. Therefore, the pressure regulator 1 has a dual-loop control structure.

Figure 5:
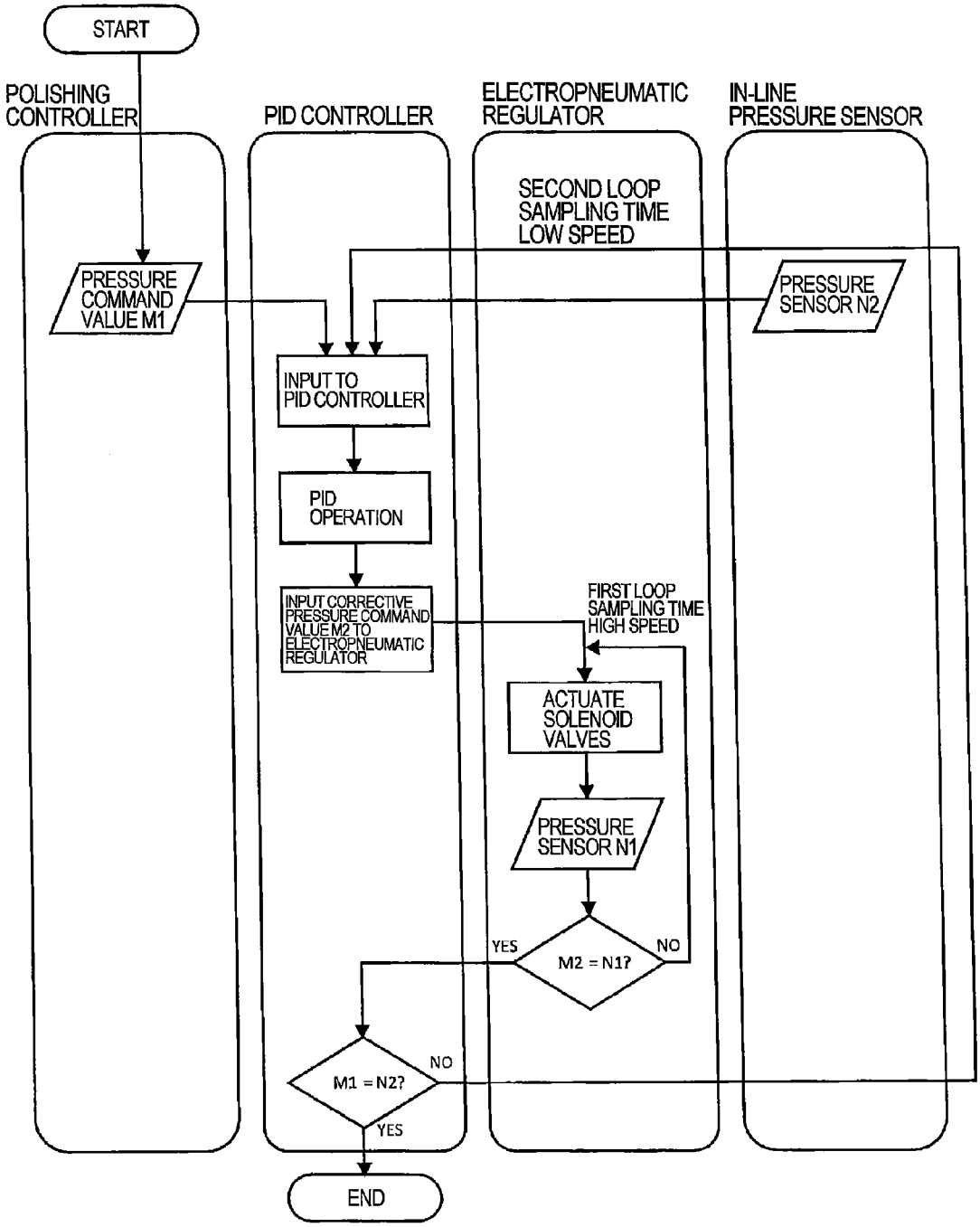
FIG. 5 is a diagram showing a control flow of the pressure regulator.

FIG. 5 is a diagram showing a control flow of the pressure regulator 1. A pressure command value M1 produced by the polishing controller 50 of the polishing apparatus is inputted to the PID controller 5. A present pressure value (second pressure value) N2 obtained by the in-line pressure sensor P1 is also inputted to the PID controller 5. The PID controller 5 performs a PID operation to produce a corrective command value M2 for eliminating a difference between the pressure command value M1 and the present pressure value N2. This corrective command value M2 is sent to the regulator controller 8 of the electropneumatic regulator R1.

The regulator controller 8 compares the corrective command value M2 and a present pressure value (first pressure value) N1 obtained by the internal pressure sensor 7, and repeats manipulations of the solenoid valves 11, 12 and the obtaining of the present pressure value N1 until the present pressure value N1 becomes equal to the corrective command value M2 (first loop control). If the present pressure values N1 is equal to the corrective command value M2, the PID controller 5 compares the pressure command value M1 and the present pressure value N2. If the present pressure values N2 is not equal to the pressure command value M1, the PID controller 5 reads the pressure command value M1 and the present pressure value N2 again, and produces the corrective command value M2 again for eliminating the difference between the pressure command value M1 and the present pressure value N2. Producing of the corrective command value M2, the first loop control, and obtaining of the present pressure value N2 are repeated until the present pressure value N2 becomes equal to the pressure command value M1 (second loop control). A sampling time of the present pressure value N1 in the first loop control may preferably be shorter than a sampling time of the present pressure value N2 in the second loop control.

The pressure command value M1 is transmitted from the polishing controller 50 to the PID controller 5. This pressure command value M1 can vary as polishing of the wafer progresses. The pressure regulator 1 is required to change pressures in the pressure chambers C1 to C6 of the top ring 30 in quick response to changes in the corresponding pressure command values M1. In addition, the pressure regulator 1 is also required to stabilize the pressures in the pressure chambers C1 to C6 after it has changed those pressures.

Figure 6:
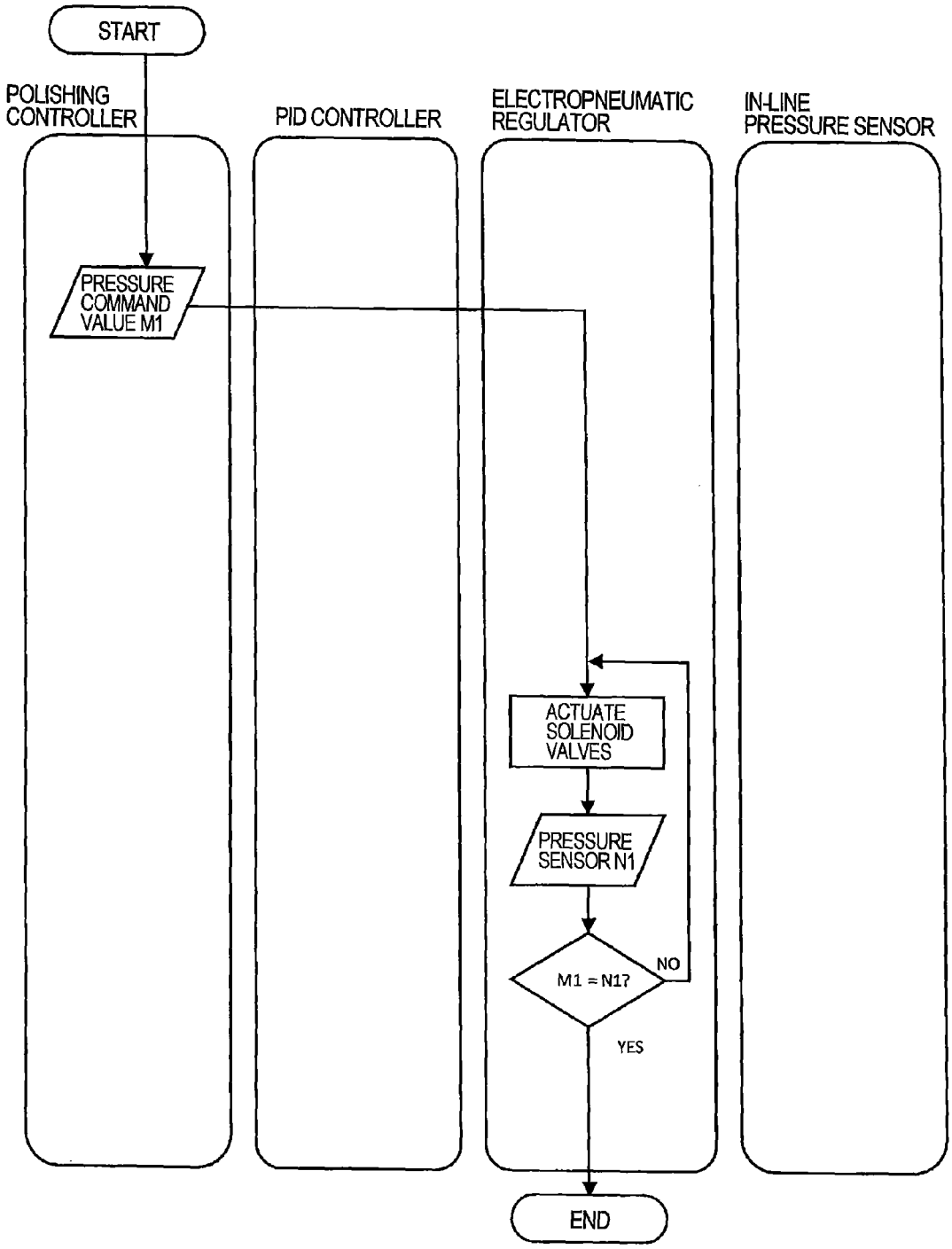
FIG. 6 is a diagram showing a control flow of the pressure regulator when a PID controller does not operate and only a regulator controller operates.

In order to quickly respond to the change in the pressure command value M1, the pressure regulator 1 stops the PID operation of the PID controller 5 and permits only the regulator controller 8 to operate when the pressure command value M1 has changed. FIG. 6 shows a control flow of the pressure regulator 1 when the PID controller 5 is not operating and only the regulator controller 8 is operating. As shown in FIG. 6, immediately after the pressure command value M1 has changed, only the first loop control is performed to regulate the pressure. Since the second loop control is not performed, the pressures in the pressure chambers C1 to C6 change gradually so as to follow the changes in the corresponding pressure command values M1. After the pressure command value M1 has changed and further a predetermined delay time has elapsed, both the first loop control and the second loop control are performed to regulate the pressure. Consequently, the pressures in the pressure chambers C1 to C6 are stabilized.

Figure 7:
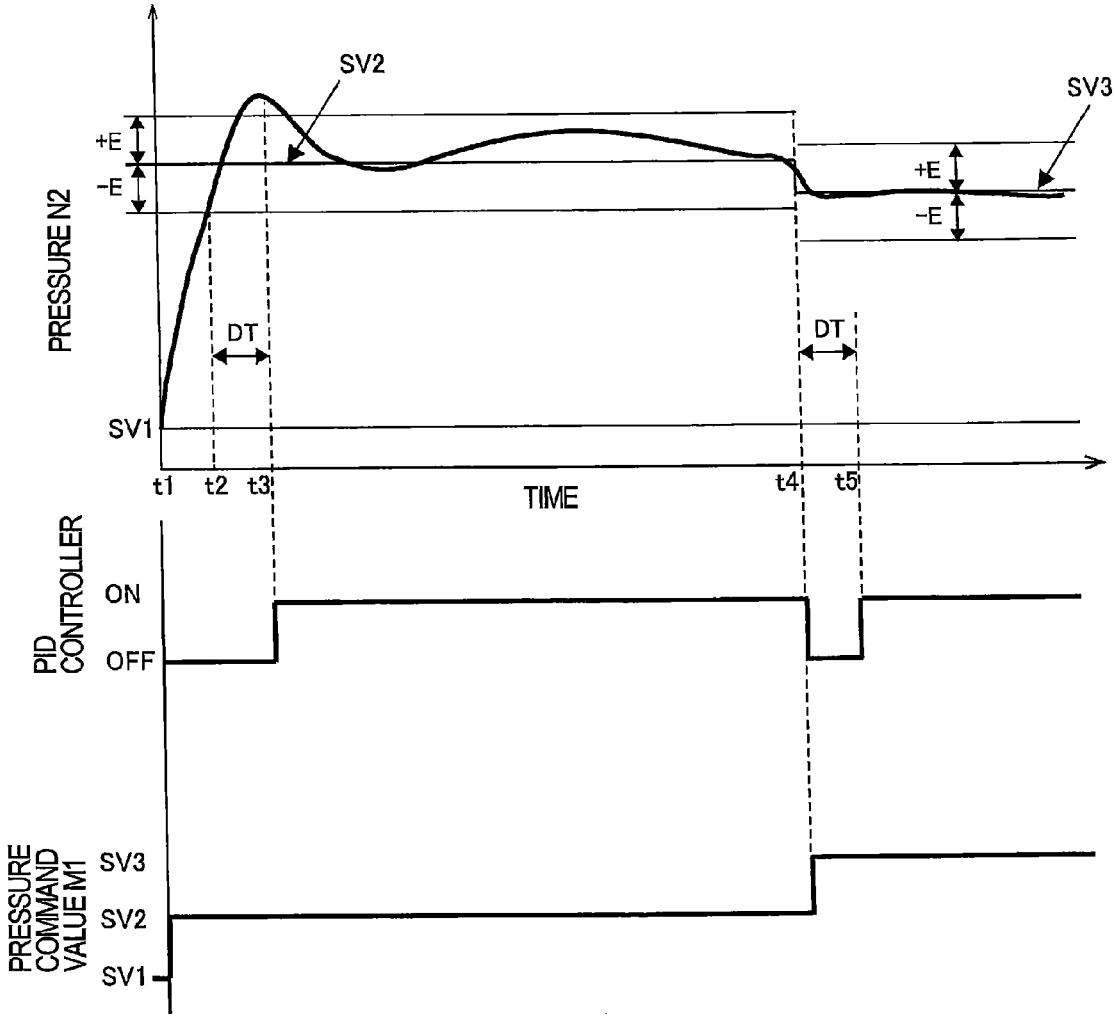
FIG. 7 is a graph showing a present pressure value (a second pressure value) that varies in accordance with a change in pressure command value transmitted from a polishing controller.

FIG. 7 is a graph showing the present pressure value (second pressure value) N2 that varies in accordance with the change in the pressure command value inputted from the polishing controller 50. As shown in FIG. 7, the PID controller 5 stops producing the corrective command value M2 from a point in time t1 to a PID control starting point t3. The point in time t1 represents a moment at which the pressure command value M1 has changed from SV1 to SV2, and the PID control starting point t3 represents a moment at which the delay time (denoted by DT) has elapsed. While the PID controller 5 is stopping producing the corrective command value M2, the regulator controller 8 controls the operation of the pressure regulation valve 6 so as to eliminate the difference between the pressure command value M1 and the present pressure value (first pressure value) N1.Therefore, the secondary pressure of the pressure regulation valve 6 is controlled by the regulator controller 8 from the point in time t1, at which the pressure command value M1 has changed, to the PID control starting point t3.

The delay time DT starts when a predetermined condition is satisfied for the first time after the pressure command value M1 has changed. This predetermined condition is that a deviation of the present pressure value (second pressure value) N2 from the pressure command value M1 that has changed falls within a predetermined range (from −E to +E). In the graph shown in FIG. 7, the delay time DT starts at a point in time t2. At this point in time t2, the deviation of the present pressure value N2 from the pressure command value M1 that has changed falls within the predetermined range (from −E to +E). Therefore, the point in time t2 is a moment at which the above-described predetermined condition is satisfied for the first time after the pressure command value M1 has changed.

The point in time t3 in FIG. 7 represents a moment at which the preset delay time DT ends (elapses). This point in time t3 is the PID control starting point discussed above. At this PID control starting point t3, the PID controller 5 starts producing the corrective command value M2. Therefore, after the PID control starting point t3, the regulator controller 8 controls the operation of the pressure regulation valve 6 so as to eliminate the difference between the corrective command value M2 and the present pressure value N1. In other words, after the PID control starting point t3, the first loop control and the second loop control are performed simultaneously.

A point in time t4 shown in FIG. 7 represents a moment at which the pressure command value M1 has further changed from SV2 to SV3. At this point in time t4, the above predetermined condition is satisfied at the same time as the pressure command value M1 changes. Specifically, when the pressure command value M1 has changed, the deviation of the present pressure value (second pressure value) N2 from the pressure command value M1 that has changed falls within the predetermined range (from −E to +E). Consequently, the delay time DT starts at the point in time t4 and ends at a point in time t5. This point in time t5 is the PID control starting point discussed above. At this PID control starting point t5, the PID controller 5 starts producing the corrective command value M2 again. After the PID control starting point t5, the regulator controller 8 controls the operation of the pressure regulation valve 6 so as to eliminate the difference between the corrective command value M2 and the present pressure value N1.

Figure 8A:
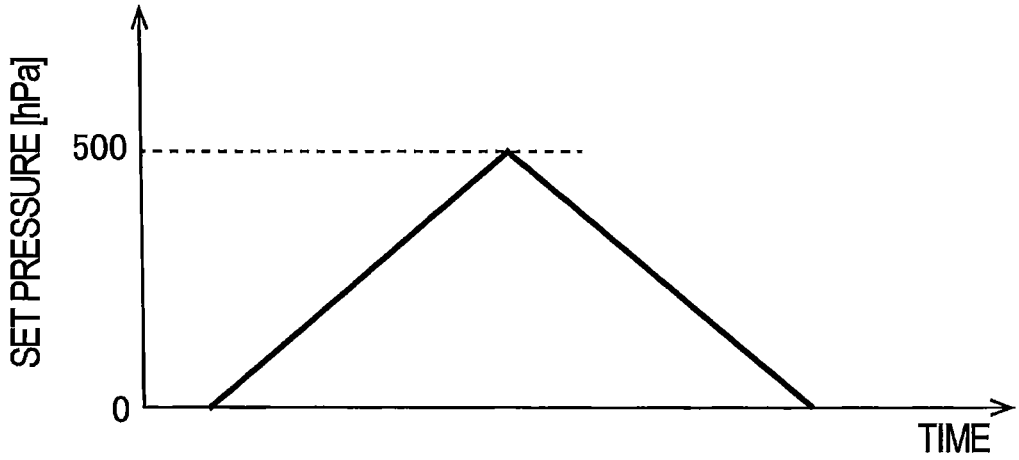
FIG. 8A and FIG. 8B are diagrams illustrating a linearity evaluation and a hysteresis evaluation.
Figure 8B:
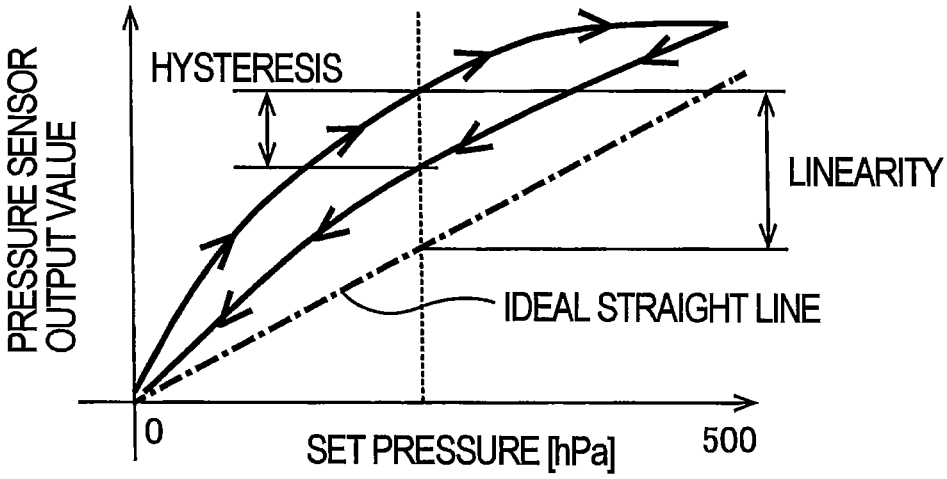

Next, evaluation results of the pressure regulator 1 will be described. The pressure regulator 1 having the above-described structures was evaluated with respect to four items; linearity, hysteresis, stability, and repeatability. FIGS. 8A and 8B are diagrams illustrating a linearity evaluation and a hysteresis evaluation. The linearity evaluation was conducted as follows. As shown in FIG. 8A, the pressure of the gas was increased linearly from 0 to 500 hPa and then decreased linearly to 0 hPa, while the pressure of the gas was measured by the in-line pressure sensor P1.

FIG. 8B is a graph showing value (sensor output value) of the pressure measured by the in-line pressure sensor P1 when the pressure of gas was changed linearly from 0 hPa to 500 hPa and further changed linearly from 500 hPa to 0 hPa. An ideal straight line shown in FIG. 8B is one that is plotted by output value of an ideal pressure sensor when the pressure of the gas was changed linearly. The linearity is represented by a maximum value of a difference between an ideal value on the ideal straight line and a corresponding output value of the in-line pressure sensor P1. The hysteresis is represented by a maximum value of a difference between a sensor output value when the pressure is being increased and a sensor output value when the pressure is being decreased.

Figure 9A:
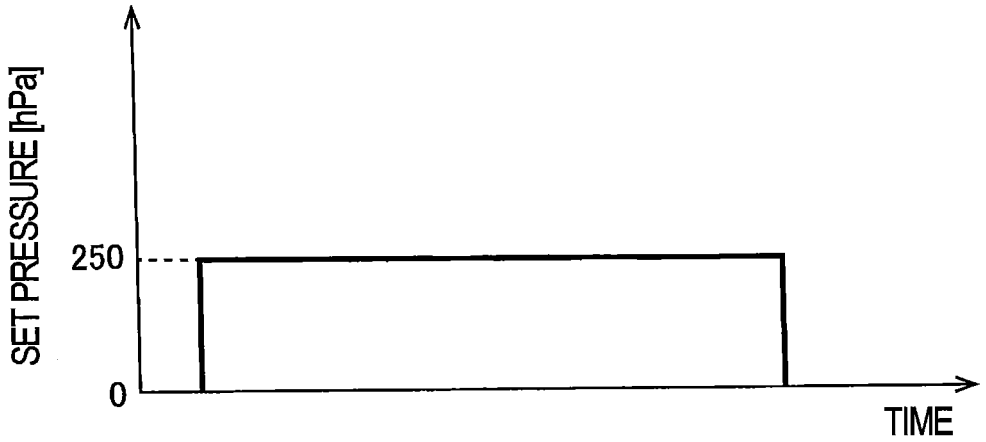
FIG. 9A and FIG. 9B are diagrams illustrating a stability evaluation.
Figure 9B:
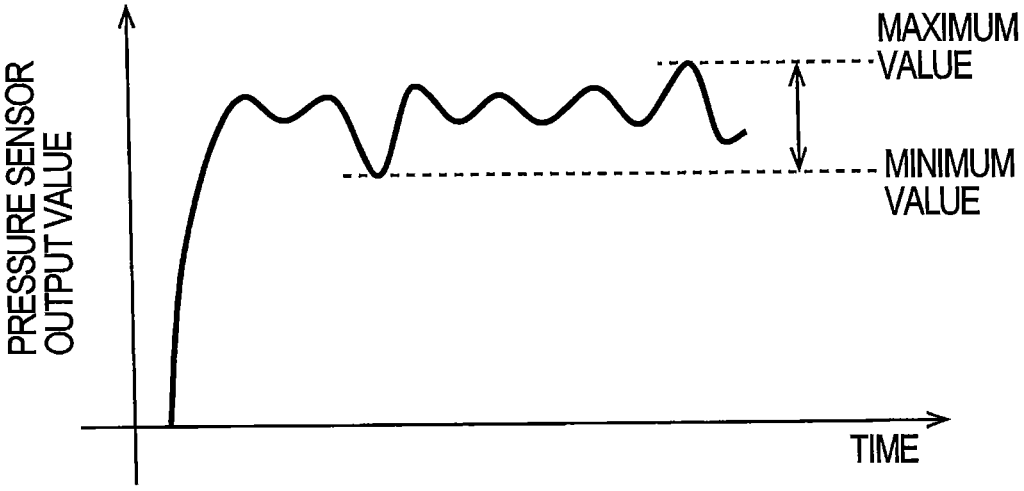

FIGS. 9A and 9B are diagrams illustrating a stability evaluation. The stability evaluation was conducted as follows. As shown in FIG. 9A, the pressure of the gas was kept at 250 hPa for two hours, while the pressure of the gas was measured by the in-line pressure sensor P1.

FIG. 9B is a graph showing output value of the in-line pressure sensor P1 when measuring the pressure of the gas that was kept at 250 hPa for two hours. As shown in FIG. 9B, although the pressure of the gas was constant, the output value of the in-line pressure sensor P1 slightly fluctuated. The stability is represented by a difference between a maximum output value and a minimum output value of the in-line pressure sensor P1 when measuring the pressure of the gas that is kept constant for a predetermined period of time.

Figure 10A:
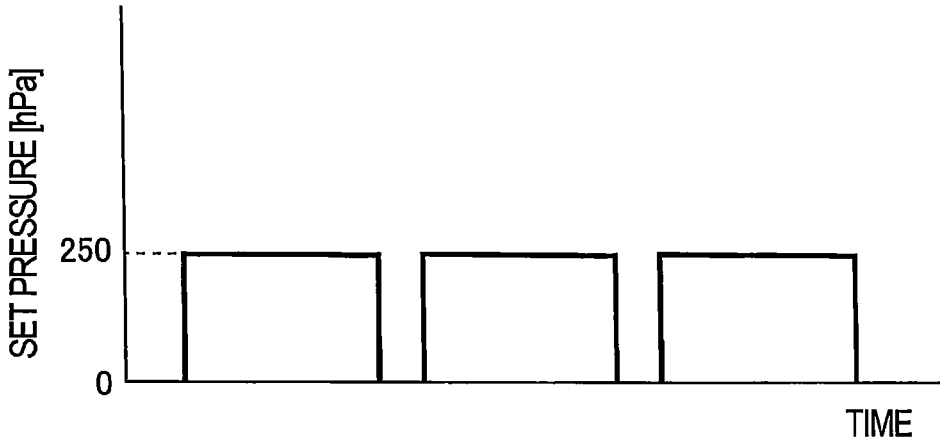
FIG. 10A and FIG. 10B are diagrams illustrating a repeatability evaluation.
Figure 10B:
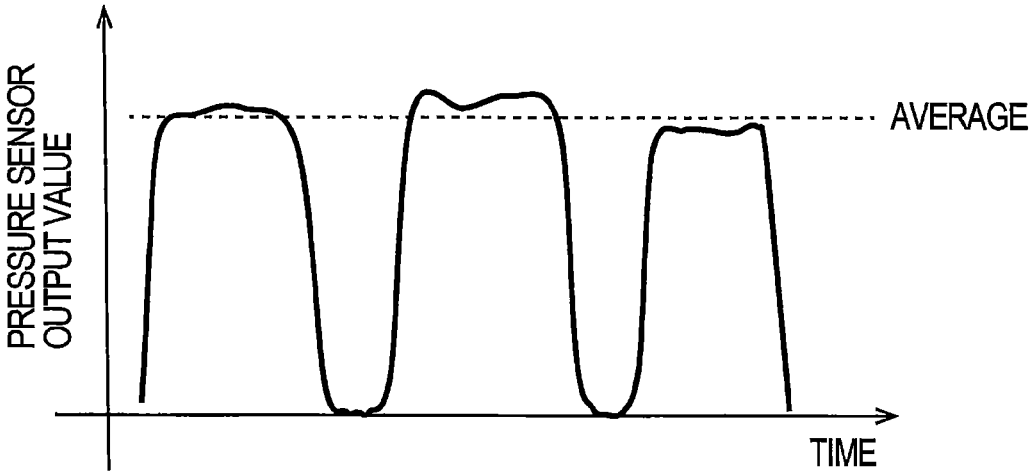

FIGS. 10A and 10B are diagrams illustrating a repeatability evaluation. The repeatability evaluation was conducted as follows. As shown in FIG. 10A, the pressure of the gas was switched between 0 hPa and 250 hPa at predetermined time intervals, while the pressure of the gas was measured by the in-line pressure sensor P1.

FIG. 10B is a graph showing pressure value (sensor output value) measured by the in-line pressure sensor P1 while the pressure of the gas was periodically switched between 0 hPa and 250 hPa. As shown in FIG. 10B, the repeatability evaluation is represented by an average of sensor output values obtained when the pressure is at a predetermined value while the pressure is being repeatedly switched between 0 hPa and the predetermined value.

Figure 11A:
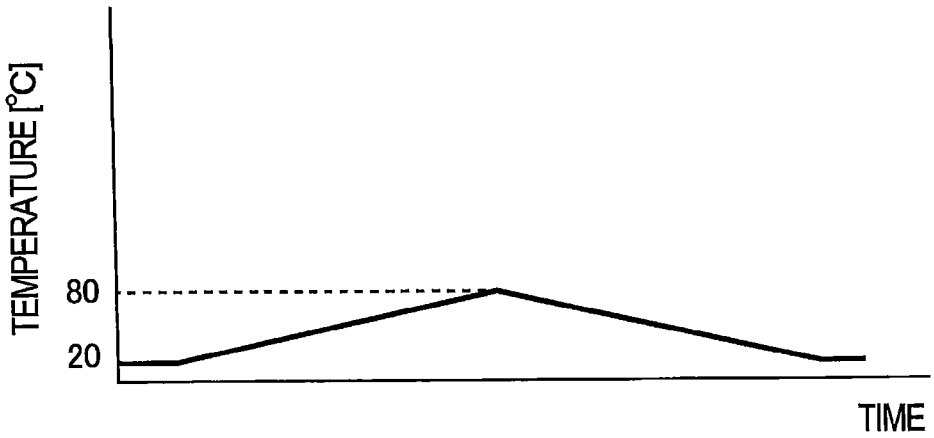
FIG. 11A and FIG. 11B are diagrams illustrating a temperature characteristic evaluation.
Figure 11B:
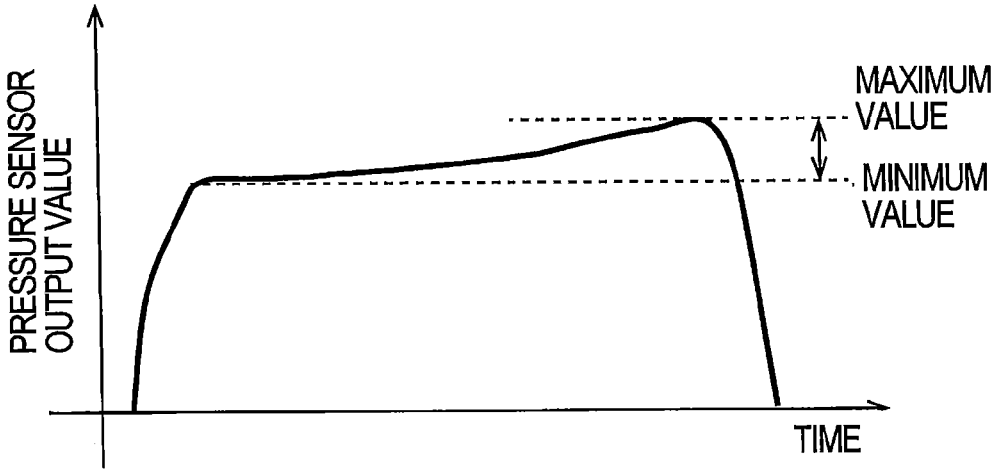

A temperature characteristic evaluation, which will be described below, may be added to the evaluation items. FIGS. 11A and 11B are diagrams illustrating the temperature characteristic evaluation. The temperature characteristic evaluation is conducted as follows. As shown in FIG. 11A, a temperature of the gas that is kept at a pressure of 250 hPa is increased from 25 degrees to 80 degrees and is then decreased back to 25 degrees, while the pressure of the gas is measured by the in-line pressure sensor P1.

FIG. 11B is a graph showing pressure value (sensor output value) measured by the in-line pressure sensor P1 when the temperature of the gas was increased from 25 degrees to 80 degrees and then decreased back to 25 degrees. As shown in FIG. 11B, although the pressure of the gas was constant, the sensor output value slightly fluctuated. The temperature characteristic is represented by a difference between a maximum and a minimum of the sensor output value when the temperature of the gas with a constant pressure is varied.

Figure 12:
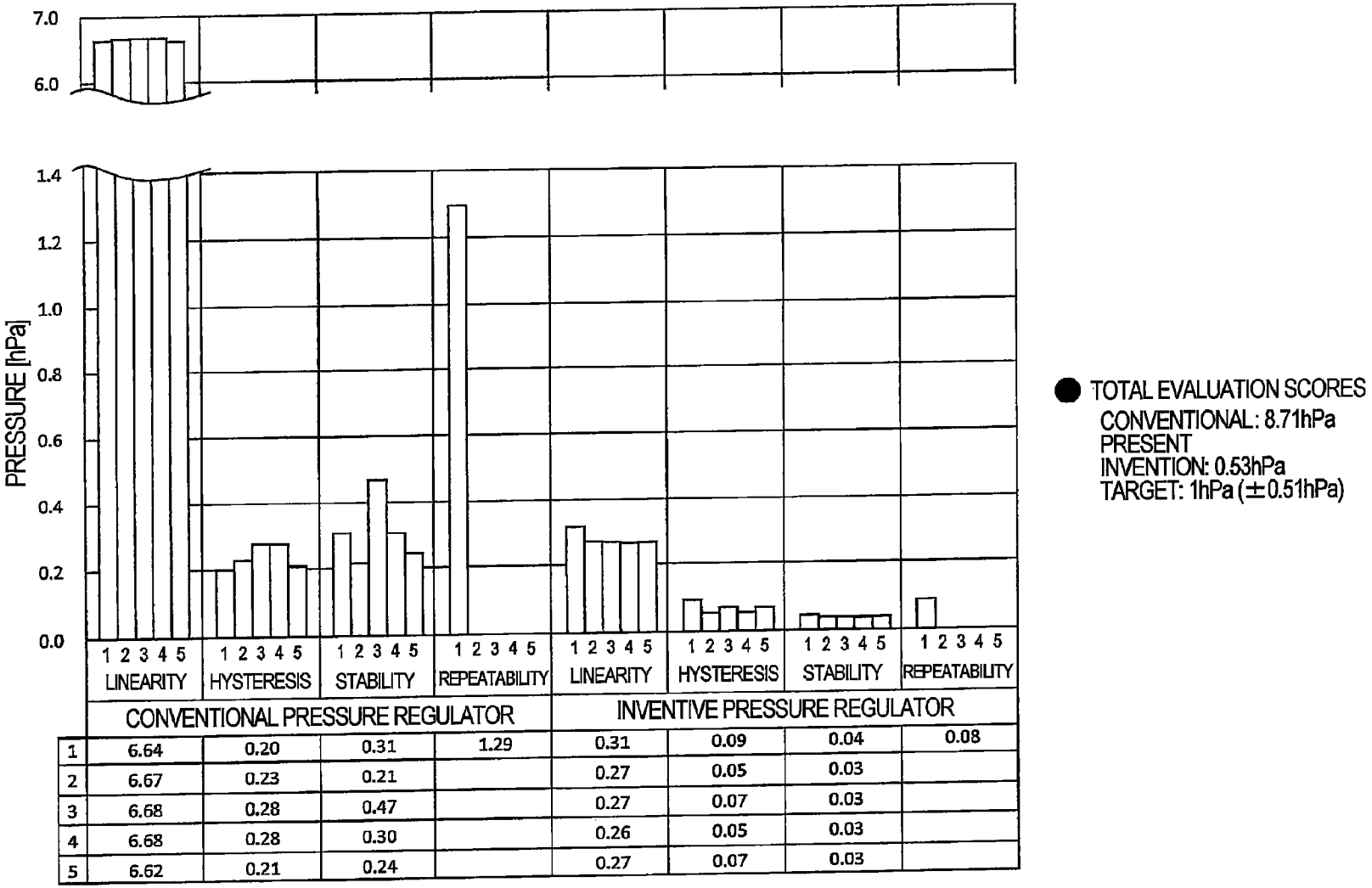
FIG. 12 is a diagram showing evaluation results of a conventional pressure controller shown in FIG. 16 and evaluation results of the pressure controller shown in FIG. 4.
Figure 16:
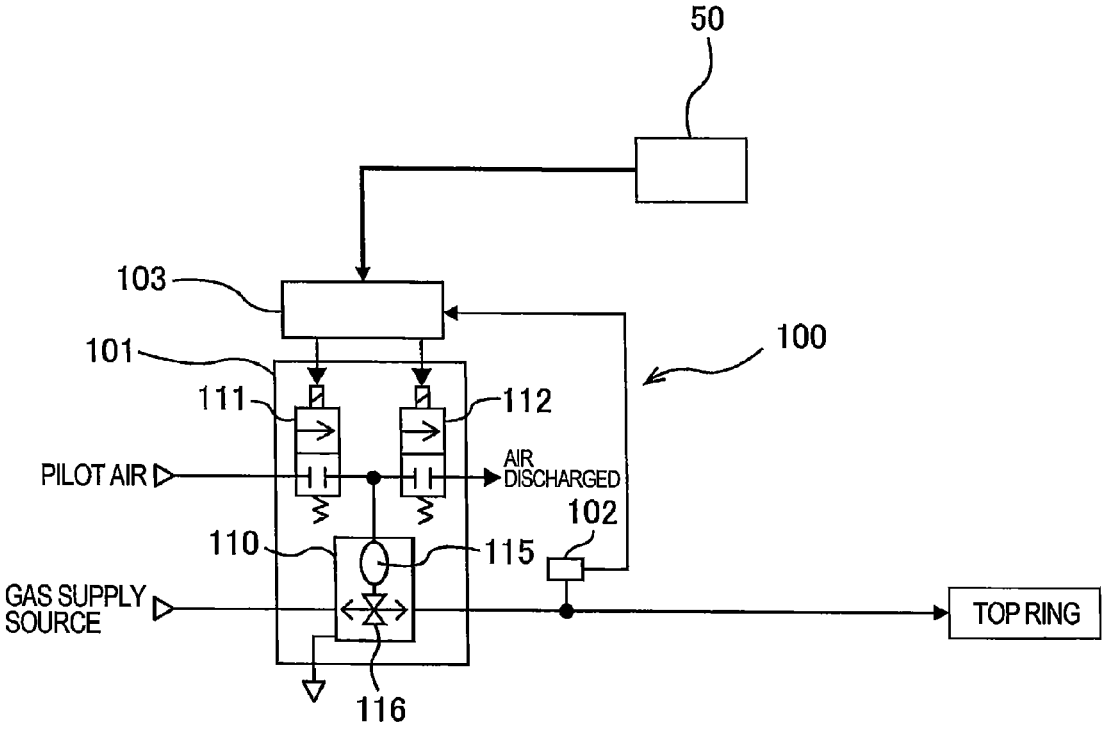
FIG. 16 is a schematic view showing a conventional pressure regulator.

FIG. 12 is a diagram showing evaluation results of the conventional pressure regulator shown in FIG. 16 and the evaluation results of the pressure regulator shown in FIG. 4. Each of total evaluation scores shown in FIG. 12 represents the sum of worst numerical values (greatest numerical values) of the scores of the respective evaluation items of the linearity, the hysteresis, the stability, and the repeatability, and indicates that the smaller the score, the higher the measurement accuracy. As can be seen from FIG. 12, the pressure regulator according to the above-described embodiment is superior to the conventional pressure regulator in all of the evaluation items. Consequently, the pressure regulator according to the embodiments is capable of accurately controlling the pressures in the pressure chambers of the top ring.

As described above, the in-line pressure sensor P1 is a high-accurate pressure sensor. However, the output values of the in-line pressure sensor P1 may deviate from correct values due to some causes. In the event that such output value deviation occurs, the in-line pressure sensor P1 is calibrated. The in-line pressure sensor P1 is calibrated using a pressure sensor (hereinafter referred to as "super-accurate pressure sensor") which is more accurate than the in-line pressure sensor P1. The super-accurate pressure sensor is coupled to the in-line pressure sensor P1. In this state, the pressure of the gas is linearly changed, while the pressure of the gas is measured simultaneously by the super-accurate pressure sensor and the in-line pressure sensor P1. Output values of these pressure sensors are sent to the PID controller 5.

The PID controller 5 compares output values of the super-accurate pressure sensor and output values of the in-line pressure sensor P1 at a plurality of predetermined pressure values, and determines differences between the output values of the respective pressure sensors at the predetermined pressure values. The PID controller 5 creates a conversion formula for eliminating the differences between the output values at the predetermined pressure values. This conversion formula is a formula for converting the output values of the in-line pressure sensor P1 into the corresponding output values of the super-accurate pressure sensor. In other words, the conversion formula is a corrective formula for correcting the output values, which include errors, of the in-line pressure sensor P1 into correct output values.

Figure 13:
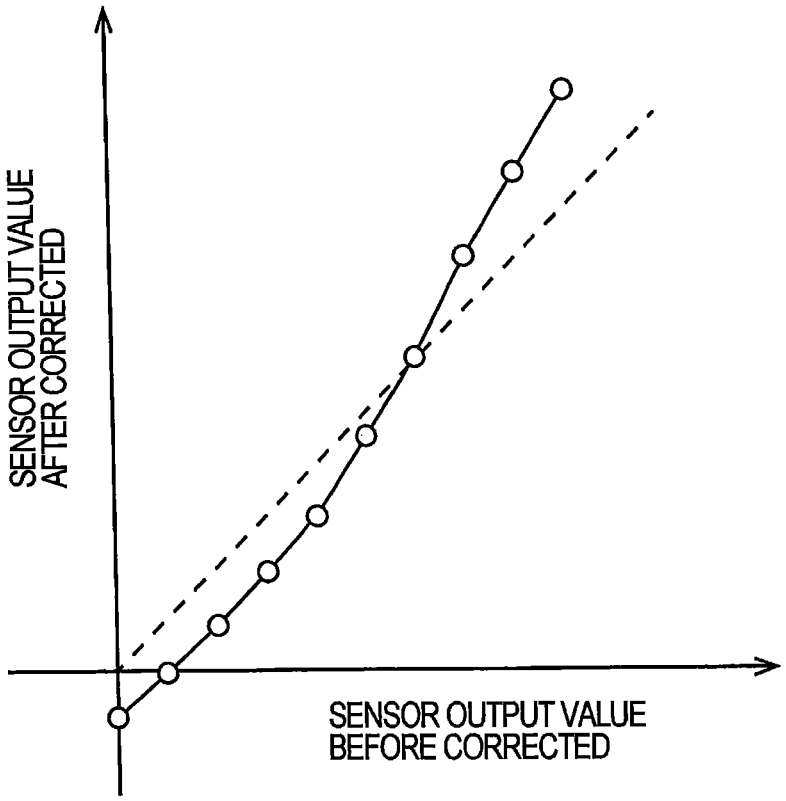
FIG. 13 is a diagram illustrating a correcting formula for correcting output values, containing errors, of an in-line pressure sensor into correct output values.

FIG. 13 is a diagram representing the conversion formula. In FIG. 13, horizontal axis represents the output value of the in-line pressure sensor P1 (i.e., the sensor output value before corrected), and vertical axis represents the output value of the super-accurate pressure sensor (i.e., the sensor output value after corrected). The conversion formula for correcting the output value of the in-line pressure sensor P1 is represented as a function of the output value of the in-line pressure sensor P1, and is described as a curve graph or polygonal line graph. When the output values of the in-line pressure sensor P1 are inputted to the conversion formula, corrected output values are obtained.

Figure 14A:
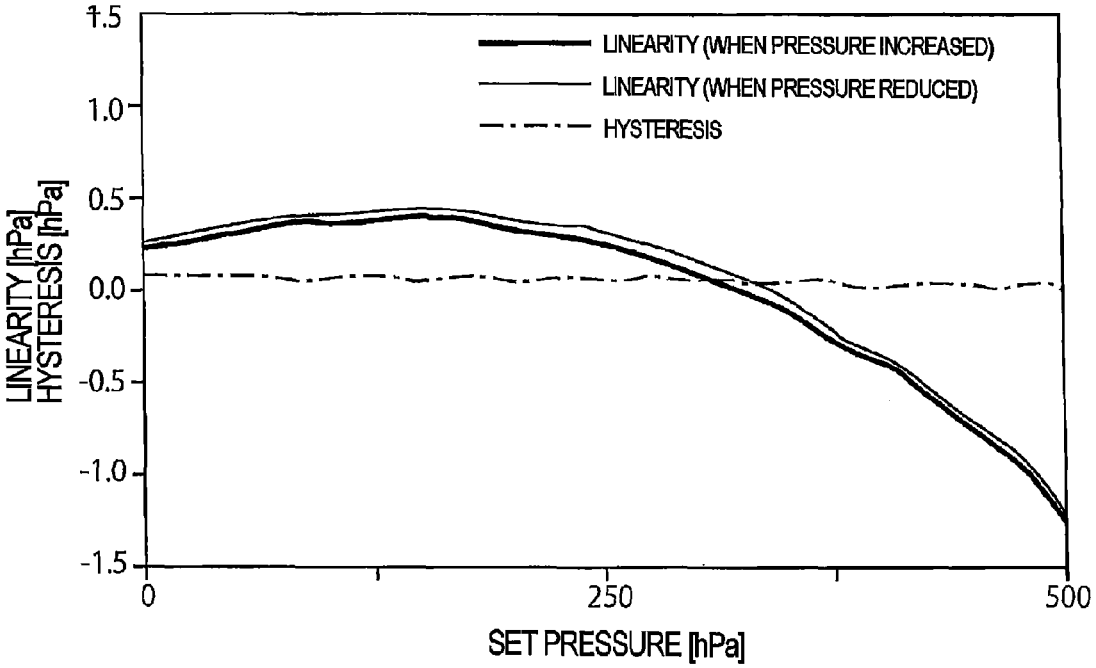
FIG. 14A is a diagram showing graphs of a linearity and a hysteresis before the output values of the in-line pressure sensor are corrected.
Figure 14B:
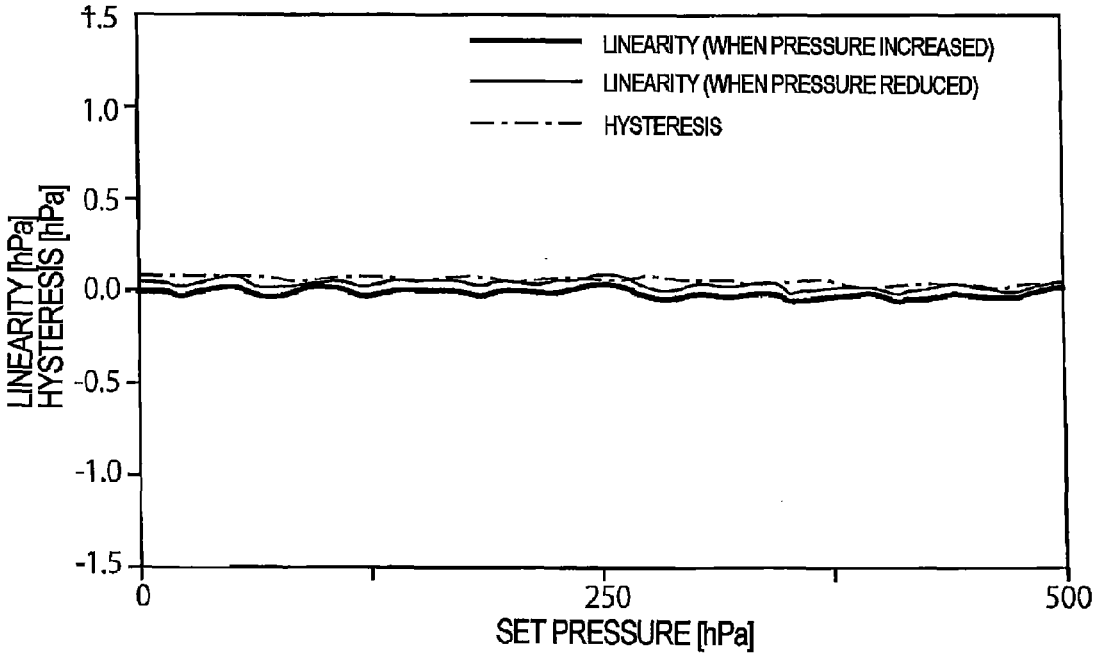
FIG. 14B is a diagram showing graphs of the linearity and the hysteresis after the output values of the in-line pressure sensor have been corrected.
Figure 15:
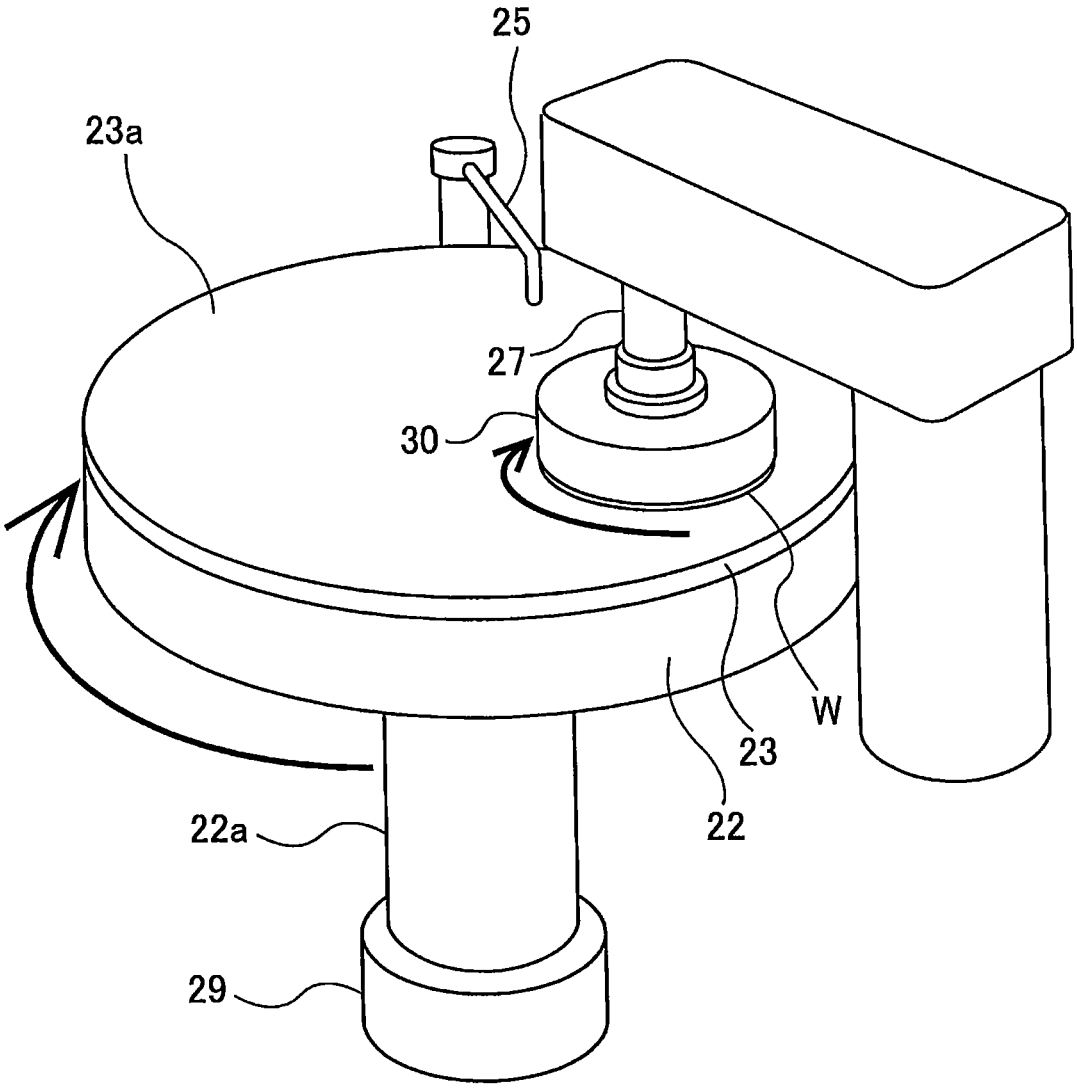
FIG. 15 is a schematic view of a polishing apparatus for polishing a wafer.

FIG. 14A is a diagram showing graphs of the linearity and the hysteresis before the output values of the in-line pressure sensor P1 are corrected, and FIG. 14B is a diagram showing graphs of the linearity and the hysteresis after the output values of the in-line pressure sensor P1 are corrected. As can be seen from the graphs shown in FIG. 14A and the graphs shown in FIG. 14B, the linearity is improved by the conversion formula. Therefore, more accurate pressure control is can be performed based on the corrected sensor output values.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A pressure regulator comprising:

a pressure regulation valve configured to regulate a pressure of a fluid supplied from a fluid supply source;

a first pressure sensor configured to measure the pressure regulated by the pressure regulation valve;

a second pressure sensor located downstream of the first pressure sensor;

a PID controller configured to produce a corrective command value for eliminating a difference between a pressure command value inputted from an external device and a second pressure value of the fluid measured by the second pressure sensor, the PID controller being configured to stop producing the corrective command value from a point in time when the pressure command value has changed until a PID control starting point and to produce the corrective command value after the PID control starting point that represents a moment at which a preset delay time has elapsed; and a regulator controller configured to control operation of the pressure regulation valve so as to eliminate a difference between a first pressure value of the fluid measured by the first pressure sensor and one of the pressure command value and the corrective command value, the regulator controller being configured to control the operation of the pressure regulation valve so as to eliminate the difference between the pressure command value and the first pressure value from the point in time when the pressure command value has changed until the PID control starting point, and to control the operation of the pressure regulation valve so as to eliminate the difference between the corrective command value and the first pressure value after the PID control starting point.

2. The pressure regulator according to claim 1, wherein the delay time starts when a predetermined condition is satisfied for a first time after the pressure command value has changed, and the predetermined condition is that a deviation of the second pressure value from the pressure command value that has changed falls within a predetermined range.

3. The pressure regulator according to claim 1, wherein the second pressure sensor has a pressure-measuring accuracy higher than that of the first pressure sensor with respect to evaluation items including linearity, hysteresis, stability, and repeatability.

4. A polishing apparatus comprising:

a polishing table for supporting a polishing pad thereon;

a top ring configured to press a substrate against the polishing pad on the polishing table, the top ring having a pressure chamber for pressing the substrate against the polishing pad;

a polishing controller configured to control operation of the top ring; and a pressure regulator coupled to the top ring and configured to regulate pressure in the pressure chamber, the pressure regulator including:

a pressure regulation valve configured to regulate a pressure of a fluid supplied from a fluid supply source;

a first pressure sensor configured to measure the pressure regulated by the pressure regulation valve;

a second pressure sensor located downstream of the first pressure sensor;

a PID controller configured to produce a corrective command value for eliminating a difference between a pressure command value inputted from the polishing controller and a second pressure value of the fluid measured by the second pressure sensor, the PID controller being configured to stop producing the corrective command value from a point in time when the pressure command value has changed until a PID control starting point and to produce the corrective command value after the PID control starting point that represents a moment at which a preset delay time has elapsed; and a regulator controller configured to control operation of the pressure regulation valve so as to eliminate a difference between a first pressure value of the fluid measured by the first pressure sensor and one of the pressure command value and the corrective command value, the regulator controller being configured to control the operation of the pressure regulation valve so as to eliminate the difference between the pressure command value and the first pressure value from the point in time when the pressure command value has changed until the PID control starting point, and to control the operation of the pressure regulation valve so as to eliminate the difference between the corrective command value and the first pressure value after the PID control starting point.

5. The polishing apparatus according to claim 4, wherein the delay time starts when a predetermined condition is satisfied for a first time after the pressure command value has changed, and the predetermined condition is that a deviation of the second pressure value from the pressure command value that has changed falls within a predetermined range.

6. The polishing apparatus according to claim 4, wherein the second pressure sensor has a pressure-measuring accuracy higher than that of the first pressure sensor with respect to evaluation items including linearity, hysteresis, stability, and repeatability.

* * * * *